United States Patent [19]

Dittrich et al.

[11] Patent Number: 4,989,843

[45] Date of Patent: Feb. 5, 1991

[54] RETAINING STRUCTURE FOR REFRACTORY LINING IN HIGH TEMPERATURE VESSEL

[75] Inventors: William B. Dittrich, Portage, Ind.; Ian D. Prendergast, State College, Pa.

[73] Assignees: Inland Steel Company, Chicago, Ill.; North American Refactories Co., Cleveland, Ohio

[21] Appl. No.: 492,285

[22] Filed: Feb. 28, 1990

Related U.S. Application Data

[63] Continuation of Ser. No. 273,071, Nov. 18, 1988, abandoned.

[51] Int. Cl.[5] ..... C21B 7/06

[52] U.S. Cl. ..... 266/283; 266/275

[58] Field of Search ..... 266/280, 283, 286, 275; 52/596, 604, 607, 597

[56] References Cited

U.S. PATENT DOCUMENTS

| | | | |
|---|---|---|---|
| 1,410,729 | 3/1922 | Balz | 266/283 |
| 3,203,688 | 8/1965 | Sieckman et al. | 266/283 |
| 3,422,857 | 1/1969 | Napora | 266/283 |
| 3,800,014 | 3/1974 | Brichard | 266/283 |
| 4,079,184 | 3/1978 | Bahout et al. | 266/280 |
| 4,155,703 | 5/1979 | Mantey et al. | 266/280 |
| 4,900,249 | 2/1990 | McCollum et al. | 266/283 |

FOREIGN PATENT DOCUMENTS

| | | | |
|---|---|---|---|
| 7100228 | 7/1971 | Netherlands | 266/283 |

*Primary Examiner*—S. Kastler

*Attorney, Agent, or Firm*—Marshall, O'Toole, Gerstein, Murray & Bicknell

[57] ABSTRACT

A high temperature vessel, such as a ladle for containing molten metal, comprises a metal outer shell and a refractory inner lining. The interior of the vessel has a curved cross-section in a plane transverse to the center line of the vessel, and there is an opening at one end of the vessel. There can be forces which urge the refractory lining toward the open end, and structure is provided at the open end to retain the refractory lining in place against the urging of those forces. The retaining structure comprises an end course of refractory retaining bricks and metal retaining member thermally protected by the end course. The metal retaining member holds the end course in place, and the end course cooperates with retaining member to hold the vessel's refractory lining in place. The metal retaining member has a protrusion preferably with a curved outer surface, and each retaining brick has a recess with a curved inner surface, devoid of sharp angles or corners, for receiving the protrusion.

29 Claims, 2 Drawing Sheets

RETAINING STRUCTURE FOR REFRACTORY LINING IN HIGH TEMPERATURE VESSEL

This application is a continuation of application Ser. No. 273,071, filed Nov. 18, 1988, abandoned.

BACKGROUND OF THE INVENTION

The present invention relates generally to high temperature vessels having a refractory lining and, more particularly, to structure for retaining the refractory lining in place in such a vessel.

High temperature vessels of the type to which the present invention relates include ladles for containing molten metal, tilting furnaces, rotary kilns, or any other vessel lined with a refractory material and having a curved interior cross-section. Such a vessel typically includes a metal outer shell, an inner lining composed of a plurality of aligned or superimposed courses of refractory brick and an opening at one end of the vessel. In the absence of structure at the open end for retaining the refractory bricks in place, a force exerted on the refractory bricks, in a direction toward the vessel's open end, could cause one or more courses of refractory bricks to fall out at the open end. This could occur, for example, if a ladle were tilted so that the open end was totally or substantially inverted, as when a ladle is tilted to empty it of residual slag or the like. In such a case, the weight of the inverted lining, itself, would be enough to cause refractory bricks to fall out.

Various structures have been employed in the past to retain the refractory lining in place, but all of these prior art structures have had drawbacks or defects. One such prior art retaining structure was in the form of a steel angle iron having one flange attached to the inner surface of the ladle's outer shell, adjacent the ladle's open end, and another flange, unenclosed by refractory material, extending from its junction with the one flange, at the ladle's open end. This other flange extended radially inwardly, with respect to the ladle interior, a distance substantially the same as that to which the refractory material extended, and there was a layer of refractory ramming material sandwiched between the nearest course of refractory brick and one surface of the inwardly extending flange of the steel angle iron. When the ladle was wholly or substantially inverted, the aligned courses of refractory brick were supported by the inwardly extending flange of the steel angle iron, and this prevented the refractory material from falling out of the inverted ladle.

A problem arose when a ladle having this type of retaining structure was subjected to preheating. During preheating, a preheater having a cross-sectional area substantially the same as the cross-sectional area of the ladle directly faced the open end of the ladle, adjacent thereto, and hot gases were directed from the preheater through the open end into the interior of the ladle. All hot exhaust gases escaping from the interior of the ladle during the preheating operation flowed out of the ladle adjacent the retaining structure, and because the inwardly extending flange of the angle iron was not enclosed by refractory, that flange was heated by the hot exhaust gases flowing adjacent the flange, eventually causing that flange to buckle. Buckling interfered with the ability of the angle iron to perform its intended retaining function with respect to the refractory lining when the vessel was inverted.

In an attempt to solve the problem described in the preceding paragraph, the angle iron was turned around so that the inwardly extending flange of the angle iron abutted the nearest course of refractory brick, and the entire angle iron was covered with a layer of refractory ramming material, reinforced with so called "crows foot" elements. However, this embodiment also presented problems. The refractory ramming material was exposed to wear, thereby requiring more frequent maintenance on the ramming material.

In addition, during those instances when the courses of refractory brick had to be removed, for periodic relining of the ladle, the inwardly extending flange of the angle iron was located directly in the path of the jackhammer normally employed to remove the courses of refractory brick. The jackhammer normally extends into the ladle through the ladle's open end along a line substantially parallel to the center line of the ladle, and the jackhammer removes the courses of refractory brick, starting with the course nearest the open end and proceeding toward the other end of the ladle. When the inwardly extending flange of the angle iron retaining member is disposed in the manner described in the preceding paragraph, there is an increased likelihood that the angle iron will be damaged by the jackhammer, and the angle iron will require more frequent replacement.

SUMMARY OF THE INVENTION

The present invention provides retaining structure for the refractory lining which avoids the drawbacks and deficiencies of the prior art structures described above. Retaining structure in accordance with the present invention includes an end course of refractory retaining bricks, at the open end of the vessel, and a metal retaining member adjacent the open end for cooperating with the end course of retaining bricks. The metal retaining member comprises a base portion, attached to the inner surface of the metal shell at the open end of the vessel, and a protrusion extending from the base portion inwardly toward the interior of the vessel. Each retaining brick includes a recess facing the metal shell and comprising means for receiving the protrusion. The protrusion comprises structure for retaining the end course of retaining bricks in place, and the end course comprises structure cooperating with the retaining member for retaining the vessel's inner lining of refractory material in place. There is a space between the exterior surface of the protrusion and the interior surface of the recess, and castable or other monolithic refractory material substantially fills that space.

The protrusion is totally encased within refractory material, so that there is no danger of buckling on the part of any portion of the metal retaining member when hot exhaust gases flow outwardly from within the vessel adjacent the retaining structure during a preheating operation.

The protrusion extends inwardly toward the interior of the vessel a distance which is relatively insubstantial compared to the distance to which the vessel's refractory lining extends. Therefore, when a jackhammer is employed to remove the courses of refractory brick from which the lining is formed, the protrusion does not extend inwardly sufficiently to interfere with the action of the jackhammer, and there is no likelihood of damaging the protrusion when the jackhammer is in operation.

In a preferred embodiment, the protrusion has rounded exterior surfaces, and the recess which receives the protrusion has rounded interior surface, there being no sharp angles or corners on either surface. Sharp corners are undesirable because they are sites for cracking and the like on a retaining brick. Cracking and the like of retaining bricks can lead to deterioration of the end course, and this in turn can interfere with the function of the retaining structure.

Other features and advantages are inherent in the structure claimed and disclosed or will become apparent to those skilled in the art from the following detailed description in conjunction with the accompanying diagrammatic drawings.

DETAILED DESCRIPTION

Figure 1:
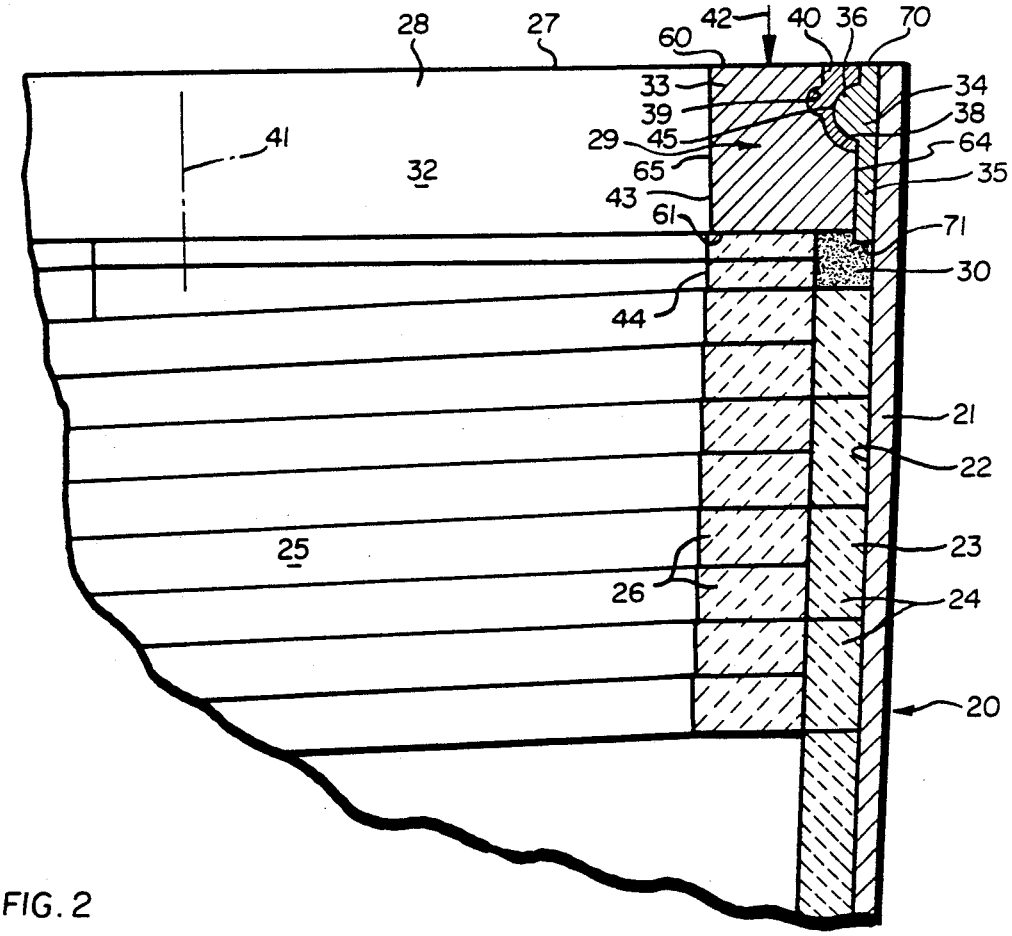
FIG. 1 is a fragmentary vertical sectional view of a ladle for containing molten metal and having retaining structure in accordance with an embodiment of the present invention.

Referring initially to FIG. 1, indicated generally at 20 is a vessel for use at elevated temperature, in the form of a ladle for containing molten metal such as molten steel. Ladle 20 has trunnions 18, 19 (FIG. 2) and comprises a metal outer shell 21 having an inner surface 22 lined with refractory material. More particularly, located adjacent the shell's inner surface 22 is an outer or safety refractory layer 23 composed of a plurality of courses of refractory bricks 24, 24. Safety layer 23 is located between metal shell 21 and an inner or wear refractory layer 25 composed of a plurality of courses of refractory brick 26, 26. Safety layer 23 and wear layer 25 together make up the inner refractory lining for ladle 20.

In FIG. 1, ladle 20 is shown in a vertical disposition, and it has an opening 28 at its upper end 27. Located at upper end 27 is retaining structure 29 for retaining the ladle's refractory inner lining in place.

Figure 3:
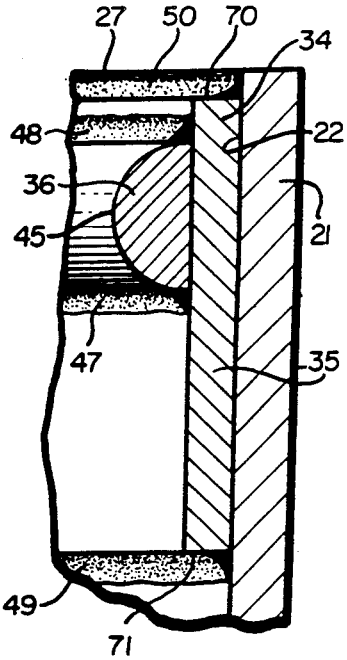
FIG. 3 is an enlarged, fragmentary sectional view of the ladle showing a portion of the retaining structure.
Figure 4:
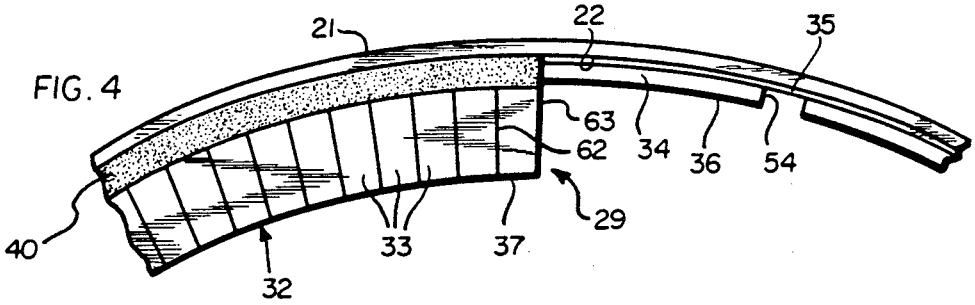
FIG. 4 is a fragmentary plan view showing the retaining structure, with part of the refractory material removed.

Referring now to FIGS. 1 and 4, retaining structure 29 comprises an end course 32 of refractory retaining bricks 33, 33 facing inwardly in side-by-side relation at upper ladle end 27 alongside the retaining bricks. Located adjacent upper ladle end 27 is a retaining member 34 composed of metal (e.g., steel). Retaining member 34 cooperates with retaining bricks 33, 33 to retain the ladle's inner lining in place. As shown in FIGS. 1–4, retaining member 34 comprises a base portion 35, attached to the ladle shell's inner surface 22 at the ladle's upper end 27, and a protrusion 36 extending from base portion 35 inwardly toward the interior of ladle 20.

Each retaining brick 33 includes a recess 38 facing metal shell 21 and receiving protrusion 36 from a horizontal direction (FIG. 1). As shown in FIG. 1, recess 38 has an open upper end facing vessel upper end 27. Protrusion 36 comprises structure for retaining end course 32 in place, and end course 32 comprises structure cooperating with retaining member 34 for retaining in place the ladle's inner lining composed of wear layer 25 and safety layer 23.

Referring to FIG. 3, base portion 35 of retaining member 34 extends from protrusion 36 along the inner surface 22 of metal shell 21 toward the ladle's upper end 27, to reinforce shell 21 at end 27. In addition, base portion 35 extends from protrusion 36 along the shell's inner surface 22 away from upper end 27.

As noted above, the ladle's refractory inner lining comprises a wear layer 25 of bricks 26 facing the ladle's interior and a safety layer 23 of bricks 24 between wear layer 25 and metal shell 21. End course 32 of retaining bricks 33 overlies all of wear layer 25, for retaining the wear layer in place, and overlies part of safety layer 23 to assist in retaining the safety layer in place. Base portion 35 of retaining member 34 is in superimposed relation with safety layer 23, and base portion 35 participates in retaining the safety layer in place. A refractory fill material 30 is located between base portion 35 and safety layer 23, along the inner surface 22 of shell 21.

Protrusion 36 on retaining member 34 has a rounded exterior surface devoid of sharp corners (FIGS. 1 and 3). Similarly, retaining brick recess 38, which receives protrusion 36, has a rounded interior surface conforming substantially to the rounded exterior surface on protrusion 36. Between the exterior surface of protrusion 36 and the interior surface of recess 38, there is a filled space occupied by monolithic refractory material 40 (e.g., castable or rammed refractory). Recess 38 has a depression 39 comprising a keyway for monolithic refractory material 40 (FIG. 1).

End course 32 substantially fully encases metal retaining member 34 and, with monolithic refractory material 40, comprises refractory structure for protecting metal retaining member 34 against buckling caused by hot gases exhausted from within the ladle's interior, through opening 28 at the ladle's upper end 27 adjacent retaining member 34. End course 32 and monolithic material 40 also protect retainer member 34 and outer shell 21, adjacent end 27, against so called arc wash from the arc furnace at a ladle metallurgy station and from splashes of slag and molten metal.

Periodically, the ladle's wear layer 25 has to be replaced, and this requires the removal of the wear layer, or the remnants thereof, already in place. Removal of the various courses of refractory brick 26 which make up the wear layer is performed with a jackhammer which extends into the ladle from upper end 27 along a line 42 substantially parallel to the ladle's center line 41. In the process of removing wear layer 25, one would also have to remove end course 32. As best shown in FIG. 1, retaining member 34 has a shape and dimensions which enable the retaining member to avoid substantial damage thereto when refractory end course 32 and that part of the refractory wear layer adjacent upper end 27 is removed with the jackhammer which digs into the refractory along substantially a downward extension of dash-dot line 42 as viewed in FIG. 1.

Safety layer 23 normally is replaced substantially less frequently than is wear layer 25. Retaining member 34 overlies the outermost part of safety layer 23. However, in those instances where the safety layer has to be replaced, and removal thereof requires the employment of a jackhammer, the shape and dimensions of the retaining member are such as to enable the retaining member to avoid substantial damage thereto by the jackhammer. In other words, the shape and dimensions of the retaining member are such that it does not interfere with the employment of a jackhammer when the latter is utilized to remove the totality of the ladle's inner refractory lining.

In some ladles, the inner refractory lining does not include a safety layer. Instead, the wear layer extends all the way to the inner surface 22 of metal shell 21. In such cases, replacement of the wear layer would require the use of a jackhammer to remove the inner refractory lining all the way to the shell's inner surface 22, but, as in the case described in the preceding paragraph, the shape and dimensions of retaining member 34 are such as to enable it to avoid substantial damage by the jackhammer.

End course 32 terminates at an interior surface 43 spaced a first distance from the metal shell's inner surface 22. Wear layer 25 terminates at an interior surface 44 spaced from the metal shell's inner surface 22 a distance at least as great as the first distance, described in the preceding sentence. The retaining member's protrusion 36 terminates at an inner end 45 spaced a second distance from the metal shell's inner surface 22, and this second distance is relatively insubstantial compared to the above-described first distance, e.g., less than 25% of the first distance. In a typical example, the first distance could be 6 inches (15.2 cm.) and the second distance could be 1.5 inches (3.8 cm.).

The dimensional relationship described in the preceding paragraph is one of the dimensional constraints on the retaining member which enables it to avoid substantial damage during removal of the refractory interior lining by a jackhammer, as described above It is important that recess 38 on retaining brick 33 have a rounded interior surface and be devoid of sharp corners or sharp angles which can cause cracking and deterioration of brick 33. It is desirable that the protrusion on retaining member 34 mate closely with recess 38; hence, the provision of a rounded or curved exterior surface on the protrusion.

Figure 7:
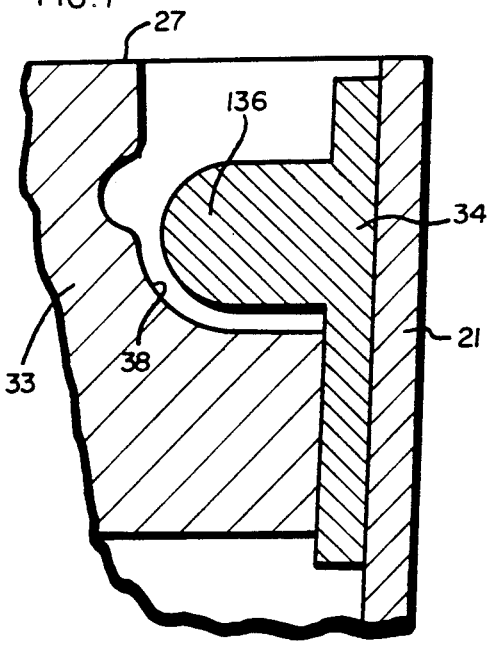
FIG. 7 is a fragmentary sectional view of another embodiment of retaining structure in accordance with the present invention.
Figure 8:
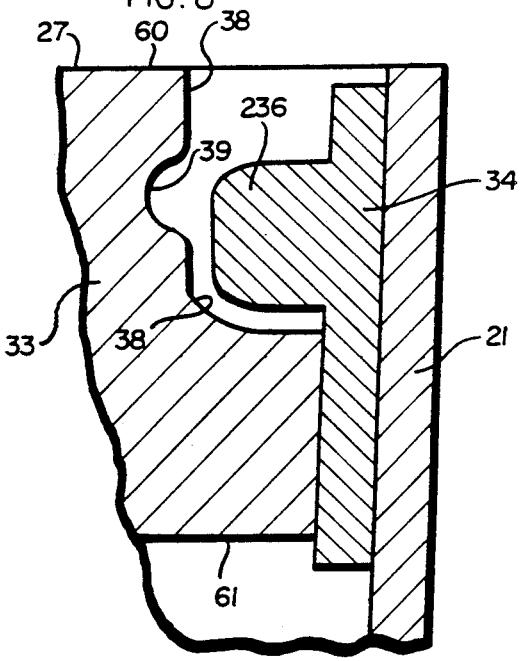
FIG. 8 is a fragmentary sectional view of a further embodiment of retaining structure in accordance with the present invention.

As shown in FIG. 1, protrusion 36 preferably has a curved cross-section along a plane extending through the protrusion and the inner lining of the ladle. Most preferably, the protrusion has a substantially semicircular cross-section (FIG. 3). However, a semicircular cross-section is not required. The protrusion may have some other exterior surface profile, preferably curved and devoid of sharp corners, as illustrated at 136 in FIG. 7 and 236 in FIG. 8. In each such instance (i.e., 36, 136 and 236), the protrusion will mate closely with the rounded interior surface of recess 38 on retaining brick 33.

In the embodiment illustrated in FIG. 3, protrusion 36 is a half-round welded at 47 and 48 to base portion 35 of retaining member 34. Base portion 35, in turn, is welded at 49 and 50 to the ladle's outer shell 21. Base portion 35 may be otherwise attached to outer shell 21, e.g., by bolting or riveting. Similarly, protrusion 36 can be otherwise attached to base portion 35.

Figure 2:
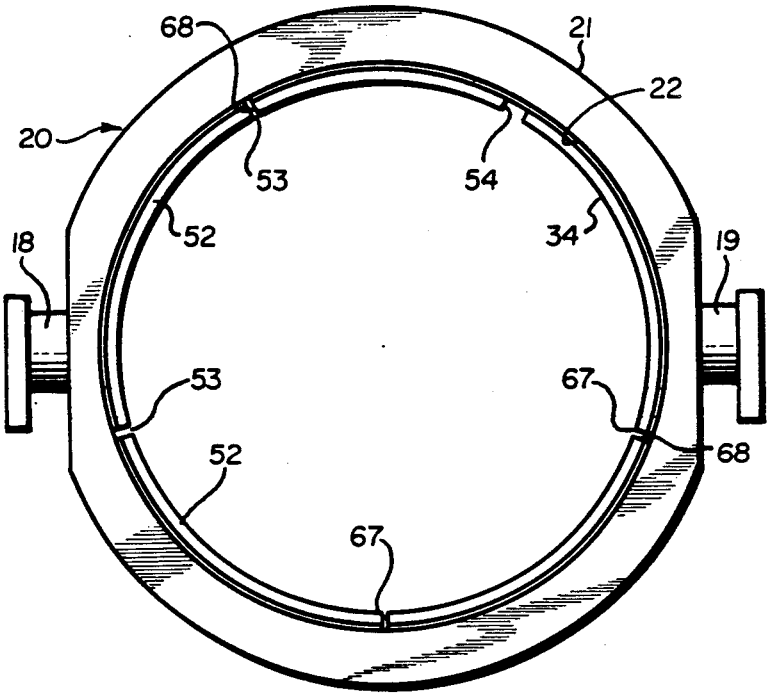
FIG. 2 is a plan view of the ladle with all refractory material removed.

As shown in FIGS. 2 and 4, the interior of the ladle has a curved periphery, as does metal outer shell 21. In the embodiment of FIG. 2, the retaining member is in the form of a plurality of curved segments 52 separated by small expansion gaps 53. Segments 52 are attached to inner surface 22 of metal outer shell 21, and segments 52 extend around the entire interior periphery of the outer shell, except for gaps 53 which accommodate thermal expansion of segments 52, in a peripheral direction, when the segments undergo heating as a result of the containment within ladle 20 of hot molten metal.

As shown in FIG. 4, retaining bricks 33 are tapered towards the interior of the ladle to accommodate the circular shape of the ladle's interior and its decreasing circumference in a radially inward direction. Almost all of the bricks 33 are emplaced in end course 32 by radial insertion outwardly from the interior of the ladle. However, because of the outward divergence of the sides 62, 63 of bricks 33 (FIG. 6), there is an insufficient gap, at the radially innermost boundary 37 of end course 32, to accommodate such radial insertion of the last tapered brick 33. Moreover, protrusion 36 prevents insertion of the last brick into place in end course 32 by insertion downwardly from upper end 27 of the ladle. Therefore, to accommodate emplacement of the last brick in end course 32, there is a peripheral gap 54 in at least protrusion 36 on retaining member 34 (FIG. 4), and this gap is wide enough to permit the last tapered refractory brick in end course 32 to be inserted into the end course downwardly from upper end 27 of ladle 20, and then be driven into place.

When ladle 20 is put into use to contain molten metal, the entire ladle, including end course 32, heats up, and retaining bricks 33 in end course 32 expand. Initially, there is a tendency to expand toward ladle end 27, but that expansion encounters protrusion 36 on retaining member 34 which prevents any further expansion in that direction. Bricks 33 then tend to expand radially inwardly toward the ladle's interior, and because sides 62, 63 of each brick 33 diverge radially outwardly, the radially inward expansion tightens the engagement among bricks 33, all the way around the interior periphery of the ladle, thereby enhancing the locking together of bricks 33 in end course 32.

In the absence of protrusion 36 on retaining member 34, retaining bricks 33 would continue to thermally expand in the direction of ladle end 27, and they would not lock in place in the manner described in the preceding paragraph. Absent protrusion 36, when the ladle is tilted to remove the contents thereof, bricks 33 could fall out of their emplacement in end course 32. If that occurred, there would be nothing holding wear layer 25 in place, and that could fall out also. The entire weight of at least wear layer 25 rests against end course 32, when the ladle is inverted. Other than the retaining structure composed of retainer member 34 and end course 32, there is nothing to hold the ladle's inner lining in place, when the ladle is inverted. The ladle is inverted at least partially to empty it of molten metal, and it may be completely inverted to empty it of slag and other residual material at the end of a teeming operation.

Figure 5:
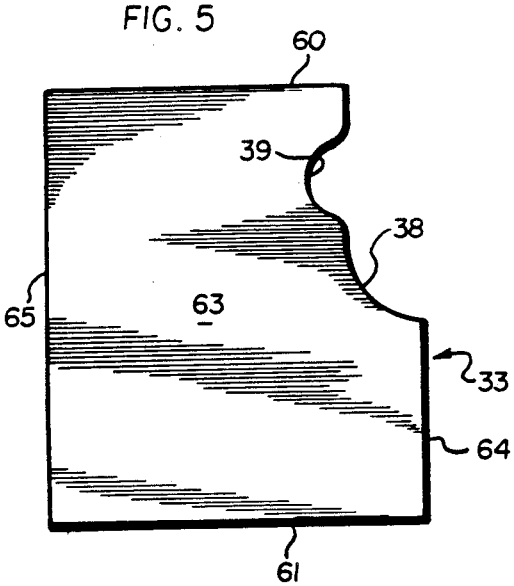
FIG. 5 is a side elevational view of an embodiment of refractory retaining brick employed in the retaining structure.
Figure 6:
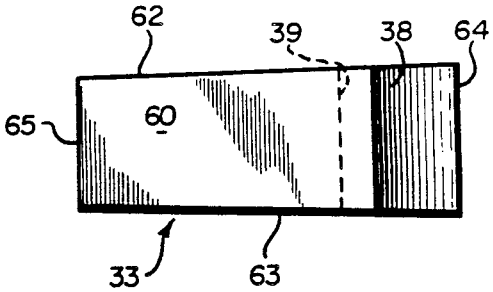
FIG. 6 is a plan view of the brick of FIG. 5.

Additional details of refractory brick 33 will now be described, with reference to FIGS. 5 and 6. Refractory brick 33 has a pair of opposite ends 60, 61 and a pair of opposite sides 62, 63 each located between ends 60, 61. Recess 38 is located between ends 60, 61 and extends from one side 62 to the other side 63 of brick 33. Protrusion 36 has a substantially semicircular cross-section in a plane extending through both ends 60, 61 of brick 33 (FIG. 1).

Retaining brick 33 has one surface 64 facing retaining member 34 and another surface 65 spaced from surface 64. In addition, surface 65 is spaced from base portion 35 of retaining member 34 a distance corresponding to the distance by which interior surface 43 of end course 32 is spaced from base portion 35 (FIG. 1). Brick surfaces 64, 65 are each located between brick sides 62, 63 and brick ends 60, 61. Recess 38 is located in brick surface 64. Depression 39 extends from recess 38 toward brick surface 65.

Referring to FIGS. 1–3, each segment 52 of retaining member 34 has a pair of circumferentially spaced, opposite sides 67, 68 (FIG. 2) and a pair of vertically spaced, opposite ends 70, 71 (FIGS. 1 and 3). Protrusion 36 is located between ends 70, 71 and extends from one side 67 toward the other side 68 of the retaining member. As noted above, there is a gap 54 in protrusion 36 which allows the last refractory brick 33 in end course 32 to be inserted into the end course downwardly from ladle end 27. Gap 54 is located between sides 67, 68 of the retaining member.

With reference to FIG. 1, safety layer 23 extends from metal outer shell 21 inwardly, toward the interior of the ladle, a predetermined distance. Retaining member 34, including protrusion 36, extends from metal outer shell 21 inwardly, toward the interior of the ladle, a distance no greater than the aforementioned predetermined distance to which safety layer 23 extends.

The monolithic refractory material at 40 is merely a fill, and it is not an essential part of the retaining structure composed of end course 32 and retaining member 34. Any loss thereof during operation of the ladle would not significantly impair the function of the retaining structure.

That part of the retaining member's base portion 35 located below protrusion 36 can be eliminated in the absence of a safety layer 23. In such a case, both the wear layer 26 and the end course 32 would extend all the way to the inner surface 22 of outer metal shell 21, with end course 32 holding all the courses of wear layer in place and protrusion 36 holding end course 32 in place.

The retaining structure described above has been illustrated in connection with a ladle interior having a circular cross-section in a horizontal plane transverse to the center line of the ladle. A retaining structure composed of end course 32 and retaining member 34 would work equally as well with other curved cross-sections (e.g., an elliptical cross-section). Nor is the use of such a retaining structure limited to ladles. Any vessel employed for high temperature use would benefit from the incorporation therein of retaining structure in accordance with the present invention. Such vessels may have a curved cross-section in a horizontal plane, as does a ladle, or they may have a curved cross-section in a vertical plane, as when the vessel has a horizontally disposed center line or axis of rotation. Examples of the latter include rotary kilns or rotary furnaces for melting metal, in which case the vertical plane is transverse to the axis of rotation.

A retaining structure in accordance with the present invention has approximately the same initial cost as the prior art retaining structures described above under the heading "Background of the Invention". The principal advantage, costwise, of retaining structure in accordance with the present invention is that it requires substantially less frequent replacement. In addition, a vessel employing a retaining structure in accordance with the present invention has less downtime because it requires fewer instances of replacement than the prior art retaining structures.

Another advantage over the prior art retaining structures is that the prior art structures could not use refractory bricks at the open end of the vessel to protect or encase the retaining member from above because such bricks would fall out too easily. Instead a rammed refractory material had to be used. Rammed refractory has a relatively narrow range of refractory properties and is of relatively limited quality compared to the refractory of which preformed and bonded brick can be composed. Examples of such brick include both fired brick and chemically bonded brick. Retaining structure in accordance with the present invention enables the employment of the higher quality preformed and bonded brick refractory at the vessel's open end.

A retaining structure in accordance with the present invention may employ virtually any desirable refractory composition for the retaining bricks in the end course, and it may employ virtually any cross-sectional configuration for the metal retaining member so long as the member has a protrusion, with a preferably curved exterior surface, and an inwardly extending dimension which avoids damage by a jackhammer when the latter is used to remove the wear lining of the vessel.

One could employ a metal retaining member having a cross-sectional configuration which lacked the dimensional characteristics described in the preceding sentence but which retained the curved exterior surface on the protrusion. In such a case, some of the advantages of the present invention would still be attained, although not all of them.

The foregoing detailed description has been given for clearness of understanding only, and no unnecessary limitations should be understood therefrom, as modifications will be obvious to those skilled in the art.

We claim:

1. In a vessel for use at elevated temperatures, wherein said vessel includes (a) a metal outer shell having an inner surface, (b) an inner lining composed of a plurality of courses of refractory brick, and (c) an opening at one end of said vessel, the improvement comprising (d) retaining structure at said one end for retaining said inner lining in place, said retaining structure comprising:

an end course of refractory bricks at said one end;

and a metal retaining member adjacent said one end for cooperating with said end course of refractory bricks;

said retaining member comprising a base portion, attached to the inner surface of said metal shell at said one end of the vessel, and a protrusion extending from said base portion inwardly toward the interior of the vessel;

said end course of refractory bricks including a plurality of retaining bricks facing inwardly in side by side relation and each including a recess facing said metal shell and direction;

said recess having an open end facing said one end of the vessel;

refractory means, including said retaining bricks, for encasing said protrusion;

said protrusion comprising means for retaining said end course in place;

said end course comprising means cooperating with said retaining member for holding said inner lining in place;

and means, including said recess and said protrusion, for initially accommodating thermal expansion by said end course in a first direction toward said one end of said vessel and for then preventing further expansion in said first direction while permitting thermal expansion in an inward second direction;

said end course comprising means for tightening the engagement between said refractory bricks in the end course in response to said expansion in said second direction.

2. In a vessel as recited in claim 1 wherein:

said base portion of the retaining member extends from said protrusion along the inner surface of said metal shell toward said one end to reinforce said metal shell at said one end.

3. In a vessel as recited in claim 1 wherein:

said base portion of the retaining member extends from said protrusion along the inner surface of said metal shell away from said one end.

4. In a vessel as recited in claim 3 wherein:

said inner lining of refractory bricks comprises a wear layer of bricks facing the vessel interior and a safety layer of bricks between said wear layer and said metal shell;

said end course of retaining bricks overlies at least said wear layer for retaining the wear layer in place;

and said base portion of the retaining member is in superimposed relation with said safety layer for retaining the safety layer in place.

5. In a vessel as recited in claim 4 and comprising:

refractory fill material located between said base portion and said safety layer along the inner surface of said metal shell.

6. In a vessel as recited in claim 1 wherein:

said protrusion has a rounded exterior surface devoid of sharp corners;

and said recess has a rounded interior surface conforming substantially to the rounded exterior on said protrusion.

7. In a vessel as recited in claim 1 wherein:

said protrusion has an exterior surface;

said recess has an interior surface;

there is a space between said exterior surface of the protrusion and said interior surface of the recess;

and there is monolithic refractory material substantially filling said space.

8. In a vessel as recited in claim 7 wherein:

said recess has a depression comprising a keyway for said monolithic refractory material.

9. In a vessel as recited in claim 1 wherein:

the interior of said vessel has a curved periphery;

the retaining bricks in said end course are tapered towards the vessel interior to accommodate said curved periphery;

said retaining member extends at least substantially all the way around the curved periphery of the vessel interior;

said protrusion on the retaining member comprises means blocking insertion of a tapered retaining brick into said end course from said one end of the vessel;

and said retaining structure comprises a peripheral gap in at least the protrusion on the retaining member, for permitting a tapered retaining brick in said end course to be inserted into said end course from said one end of the vessel.

10. In a vessel as recited in claim 1 wherein:

said end course terminates at an interior surface spaced a first distance from said metal shell;

said inner lining terminates at an interior surface spaced from said metal shell a distance at least as great as said first distance;

said protrusion on the retaining member terminates at an inner end spaced a second distance from said metal shell;

and said second distance is relatively insubstantial compared to said first distance.

11. In a vessel as recited in claim 10 wherein:

said second distance is less than 25% of said first distance.

12. In a vessel as recited in claim 10 wherein:

said protrusion has a curved cross-section along a plane extending through said protrusion and said inner lining.

13. In a vessel as recited in claim 12 wherein:

said protrusion has a substantially semicircular cross-section.

14. In combination:

a refractory retaining brick;

and a metal retaining member located alongside said retaining brick for cooperating with said retaining brick;

said retaining member comprising a base portion and a protrusion extending from said base portion;

said retaining brick comprising a recess facing said retaining member;

said recess having an open upper end and comprising means for receiving said protrusion from a horizontal direction;

and refractory means, including said retaining brick, for encasing said protrusion.

15. In the combination of claim 14 wherein:

said protrusion is received within said recess;

said protrusion has a rounded exterior surface devoid of sharp corners;

and said recess has a rounded interior surface conforming substantially to the rounded exterior surface on said protrusion.

16. In the combination of claim 15 wherein:

said retaining brick has a pair of opposite ends and a pair of opposite sides each located between said ends;

said recess is located between said ends and extends from one side to the other side of the brick;

and said protrusion has a substantially semicircular cross-section in a plane extending through both ends of the brick.

17. In the combination of claim 14 wherein:

said protrusion is received within said recess;

said retaining brick has a pair of opposite ends and a pair of opposite sides each located between said ends;

said recess is located between said ends and extends from one side to the other side of the brick;

and said protrusion has a substantially semicircular cross-section in a plane extending through both ends of the brick.

18. In the combination of claim 14 wherein:

said protrusion is received within said recess;

said protrusion has an exterior surface;

there is a space between said exterior surface of the protrusion and said interior surface of the recess;

and said encasing means includes monolithic refractory material substantially filling said space.

19. In the combination of claim 18 wherein:

said recess has a depression comprising a keyway for said monolithic refractory material.

20. In the combination of claim 14 wherein:
said retaining member has a pair of opposite ends and a pair of opposite sides each located between said ends;
and said protrusion is located between said ends and extends from one side toward the other side of the retaining member.

21. In the combination of claim 20 and comprising:
a gap in said protrusion, between said sides of the retaining member.

22. In the combination of claim 20 wherein:
said retaining brick has a pair of opposite ends and a pair of opposite sides each located between said ends;
and said recess is located between said ends and extends from one side to the other side of the brick.

23. In the combination of claim 14 wherein:
said protrusion is received within said recess;
said retaining brick has one surface facing said retaining member and another surface spaced from said one surface and spaced from the base portion of said retaining member a first distance;
and said protrusion terminates at an end spaced from said base portion a second distance which is relatively insubstantial compared to said first distance.

24. In the combination of claim 21 wherein:
said second distance is less than 25% of said first distance.

25. A refractory retaining brick comprising:
upper and lower ends and a pair of opposite sides each located between said ends;
first and second surfaces located between said sides and said ends;
a recess in said first surface;
said recess being located between said ends and extending from one side to the other side;
said recess having an opening at said upper end and comprising means for receiving monolithic refractory material;
and a depression in said recess;
said depression extending from said recess toward said second surface of the brick;
said depression occupying a minor portion of that dimension of said recess extending from the brick's upper end toward the brick's lower end;
said depression comprising keyway means for keying monolithic refractory material received within said recess.

26. In a vessel for use at elevated temperatures, wherein said vessel includes (a) a metal outer shell having an inner surface, (b) an inner lining composed of a plurality of courses of refractory brick, and (c) an opening at one end of said vessel, the improvement comprising (d) retaining structure at said one end for retaining said inner lining in place, said retaining structure comprising:
a metal retaining member adjacent said open end;
refractory material including an end course of refractory retaining bricks substantially fully encasing said metal retaining member and comprising means for protecting said member against buckling caused by hot gases exhausted, from within the vessel interior, through said opening in said one end at a location adjacent said retaining member;
said metal retaining member and said end course of retaining bricks comprising means cooperating to retain said inner lining in place;
said retaining member and said end course comprising means for initially accommodating thermal expansion by said end course in a first direction toward said one end of said vessel and for then preventing further expansion in said first direction while permitting thermal expansion in an inward second direction;
said end course comprising means for tightening the engagement between said refractory bricks in the end course in response to said expansion in said second direction.

27. In a vessel as recited in claim 26 wherein:
said vessel has a center line;
and said metal retaining member has a shape and dimensions comprising means which enable the avoidance of substantial damage to said member when that part of the inner lining adjacent said one end is removed with a jackhammer extending into the vessel from said one end along a line substantially parallel to said center line of the vessel.

28. In a vessel as recited in claim 27 wherein:
said inner lining of refractory bricks comprises a wear layer of bricks facing the vessel interior and a safety layer of bricks between said wear layer and said metal shell;
said safety layer of bricks extends from said metal outer shell inwardly, toward the interior of the vessel, a predetermined distance;
and said metal retaining member extends from said metal outer shell inwardly, toward the interior of the vessel, a distance no greater than said predetermined distance.

29. A brick as in claim 25 wherein:
said recess is the only recess in the brick.

* * * * *

UNITED STATES PATENT AND TRADEMARK OFFICE

CERTIFICATE OF CORRECTION

PATENT NO. : 4,989,843

DATED : February 5, 1991

INVENTOR(S) : Dittrich, et. al.

It is certified that error appears in the above-indentified patent and that said Letters Patent is hereby corrected as shown below:

On the Title page, item [57] Abstract, line 11, after "and" insert --a--.
line 14, after "with" insert --the--.

Column 8, line 56, after "and" insert--comprising means for recieving said protrusion from a horizontal--.

Column 10, line 61, after "surface" insert --said recess has an interior surface--.

Signed and Sealed this

Ninth Day of November, 1993

Bruce Lehman

*Attest:*

BRUCE LEHMAN

*Attesting Officer*

*Commissioner of Patents and Trademarks*